United States Patent [19]

Crandall et al.

[11] 4,324,603

[45] Apr. 13, 1982

[54] HOSIERY REPAIR KIT

[76] Inventors: Janice L. Crandall; Richard W. Crandall, both of 150 W. Huron, Chicago, Ill. 60610

[21] Appl. No.: 62,510

[22] Filed: Jul. 30, 1979

[51] Int. Cl.[3] ..... B32B 35/00

[52] U.S. Cl. ..... 156/584; 156/94; 156/527; 156/577; 206/394; 206/411; 206/549; 206/582; 206/603; 242/55.3; 242/55.53; 428/40; 428/63

[58] Field of Search ..... 156/94, 527, 577, 584; 206/394, 411, 549, 582, 603; 242/55.3, 55.53; 428/40, 63

[56] References Cited

U.S. PATENT DOCUMENTS

| | | | |
|---|---|---|---|
| 2,569,398 | 9/1951 | Burd et al. | 428/78 |
| 2,667,004 | 1/1954 | Sanson | 428/11 X |
| 3,138,505 | 6/1964 | Hirsch | 156/94 |
| 4,151,039 | 4/1979 | Lash | 156/584 |

*Primary Examiner*—Edward C. Kimlin
*Assistant Examiner*—Robert A. Dawson
*Attorney, Agent, or Firm*—Hill, Van Santen, Steadman, Chiara & Simpson

[57] ABSTRACT

A hosiery repair kit includes a repair strip, textured as original hosiery material, adhesive-backed and carried in strips or a tape on a peel-off backing. The backing may be in the form of a sheet carrying several strips. As a tape, the repair material may be mounted in a dispenser which has a cutting mechanism and a take-up reel for the waste backing material.

6 Claims, 9 Drawing Figures

FIG. 1
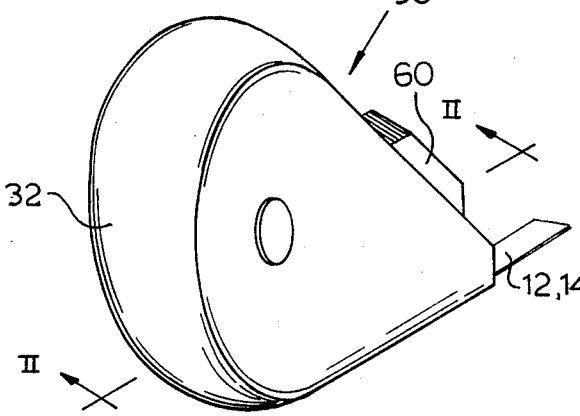
FIG. 2
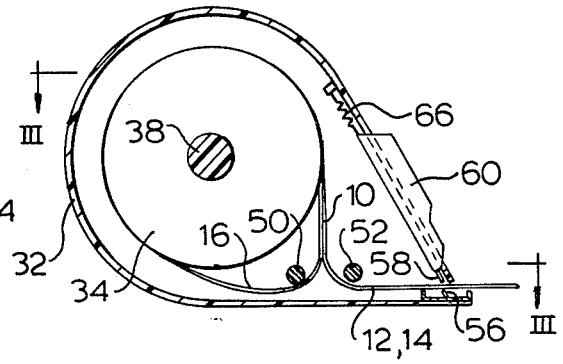
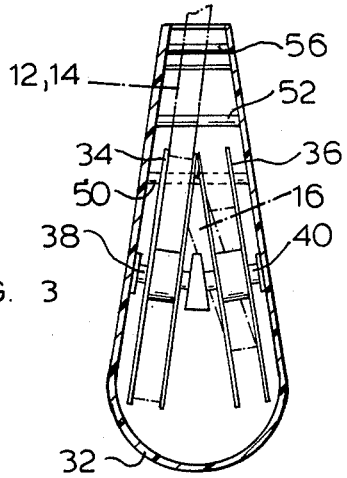
FIG. 3
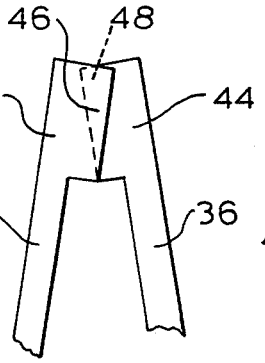
FIG. 4
FIG. 5
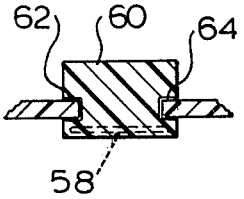
FIG. 9
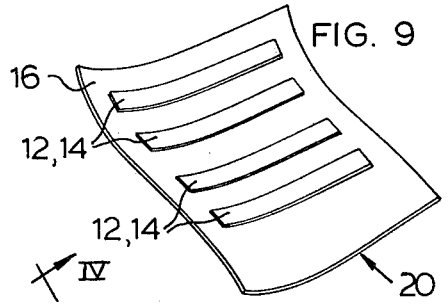
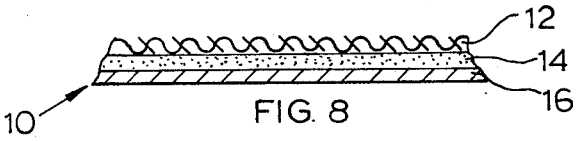
FIG. 8
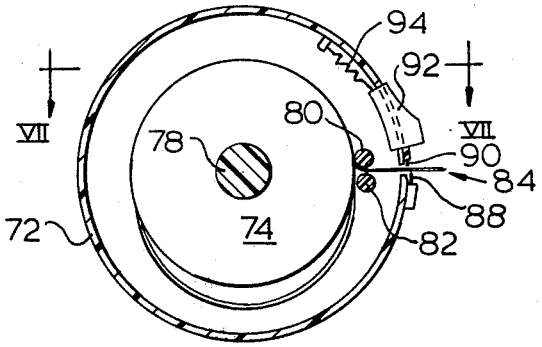
FIG. 6
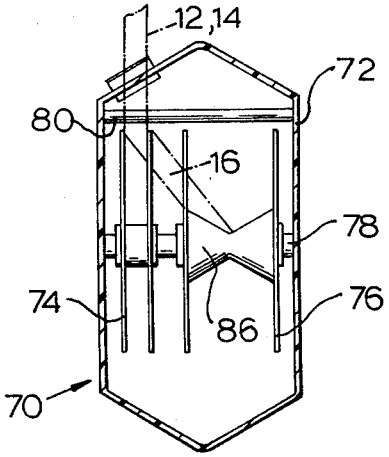
FIG. 7
IV

HOSIERY REPAIR KIT

BACKGROUND OF THE INVENTION

1. Field of the Invention

The present invention relates to a hosiery repair kit, and more particularly to a hosiery repair kit for repairing runs, holes and the like in ladies stockings.

2. Description of the Prior Art

It is well known to repair holes, runs and the like in ladies stockings by sewing, which leaves an unsightly repair.

It is also known to stop a run by applying a cement, such as clear fingernail polish or the like, to the run. This is a temporary repair and the unsightly hole or run remains totally visible.

SUMMARY OF THE INVENTION

The object of the present invention is to provide a repair kit for repairing ladies hosiery by which a hole, run or the like may be repaired and the resulting repair is practically invisible.

According to the invention, the repair kit comprises, primarily, two parts. The first part is a tape or strips of tape, the strips being provided in different colors and textures. The second part is a tape support, preferably a dispenser.

In the event of a run or other damage, the wearer can effect temporary repair and camouflage the unsightly damage. The repair kit may be carried in a purse or in a pocket and a strip of the tape may be retrieved from the kit and applied to the damaged area. Preferably, the strip of tape is mounted in a dispenser and the wearer would pull the exposed end of the tape, and adhesive-backed structure, from an access slot in the outer cover of the dispenser, align the strip with the run or damage and so as to extend approximately ½" beyond the extend of the damage and secure the tape through the application of finger pressure or draw the dispenser along the length of the run to approximately ½" beyond the end of the damage, and then sever the tape by operating a slide button cutting mechanism.

The application of finger pressure and smoothing of the tape over the length thereof secure the adhesive backing and complete the repair.

The tape or strips comprise, a strip of appropriate color and denier an adhesive of appropriate color, thickness and adhesive quality and a backing strip, such as plasticized paper. In the embodiment which does not employ a dispenser, several strips may be mounted on a common backing layer.

A dispenser may be constructed, to great advantage, to comprise an outer casing or shell, two reels mounted side-by-side and coupled together for mutual rotation including a cover strip reel which carries the supply of tape to be dispensed and a backing strip pick-up reel to take-up and store the backing strip after the same has separated from the repair strip. A cutting mechanism is provided for cutting the cover strip comprises a fixed blade and a movable blade, which together, through a scissors action, cut the cover tape. The cutting mechanism includes a sliding push button which carries the movable blade having a slide which moves in fixed slots which is advanced by finger action and returned to its original position by a bias spring so that the movable blade may be recessed into the dispenser casing. The dispenser casing includes a cover strip storage access slot beyond the cover strip exit when insertion of the cut and of the cover strip attachment strip for easy grasp the next time of use.

BRIEF DESCRIPTION OF THE DRAWINGS

Other objects, features and advantages of the invention, its organization, construction and operation will be best understood from the following detailed description, taken in conjunction with the accompanying drawings, on which:

FIG. 1 is a pictorial representation of a hosiery repair kit constructed in accordance with the principles of the present invention;

FIG. 2 is a sectional view of the repair kit of FIG. 1 taken along the parting line II—II;

FIG. 3 is a sectional view taken along the parting line III—III of FIG. 2;

FIG. 4 is a fragmentary view illustrating the interengagement of the spools illustrated in FIG. 3;

FIG. 5 is a partial fragmentary view of the slide mounting of the push button of the tape cutting mechanism;

FIG. 6 illustrates a second embodiment of the invention in somewhat of an elevational section taken along the parting line VI—VI of FIG. 7;

FIG. 7 is a sectional view of the embodiment of FIG. 6 taken along the parting line VII—VII of FIG. 6;

FIG. 8 is a fragmentary sectional view of the hosiery cover strip of tape with a removable backing; and FIG. 9 is a pictorial representation of a plurality of repair strips mounted to be peeled from a common backing.

DESCRIPTION OF THE PREFERRED EMBODIMENTS

Referring first to FIG. 8, hosiery repair material is generally illustrated at 10 as comprising a repair layer 12, an adhesive layer 14 and a backing layer 16 of, for example, plasticized paper, which may be peeled from the adhesive coated repair layer. The repair material 10 may be in the form of a strip or in the form of a tape and may be provided in various widths.

It should be recognized that the repair strip, in order to be effective, must match the original hosiery material in color, shade and denier as closely as possible. It should also be recognized that the repair material is intended as a temporary repair, and not as a permanent repair, of damage to the hose.

In order to match the original color shade, when applied to damage such as a run, which constitutes an area of partial nylon hose and retains some portion of the original coloration, the repair strip must be constructed with a lighter shade of coloration. With a lighter shade of coloration mounted on the partially colored shaded damaged area, the resulting repaired area should approximately match the original shade.

The following constructions may be employed in realizing the repair strip 12:

1. The use of a finer denier of nylon hosiery material having a equivalent matching coloration to the original material;
2. The use of a matching denier with a half shade lighter coloration difference;
3. The use of clear or colorless nylon hose material, matching denier and a half shade matching coloration added to the adhesive compound layer 14; and 4. The use of a half shade lighter plastic strip having an applied texture stamped, molded or impressed into the plastic to simulate the original nylon hose denier.

With the aforementioned repair structure, a most simple repair kit, minus an envelope or folder for housing the same, is generally illustrated in FIG. 9 at 20 as comprising a common removable backing 16' which carries a plurality of peel-off adhesive-backed repair strips 12, 14, which may be cut to proper length with scissors or the like, and which may be provided in such a card form with a plurality of colorations and/or a plurality of textures.

Another embodiment of the invention is illustrated in FIGS. 1–5 in a dispenser form 30 which comprises a housing 32 having a pair of spools 34, 36 rotatably mounted therein on respective spindles 38, 40. As best seen in FIG. 4, the spools 34 and 36 include respective inner flanges 42 and 44 having interengaged teeth 46 and 48 coupling the spools in driving engagement, the spools being rotatably mounted on the spindles 38 and 40.

The spool 34 constitutes a supply spool and carries a tape constructed along the lines illustrated in FIG. 8, while the spool 36 is a take-up spool for receiving and holding the removable backing 16.

As best seen in FIG. 2, the tape 10 is fed through a pair of guides, which could be rollers, 50 and 52 so as to direct the waste layer 16 to the spool 36 and direct the adhesive-backed repair layer 12, 14 through an exit opening 54.

A cutting mechanism is mounted adjacent the exit opening 54 and comprises a fixed cutting blade 56, which may have an angled cutting edge (not shown), and a movable cutting blade 58 (which may also have an angled cutting edge) carried by a movable push-button 60 which has a pair of slots 62 and 64, as best seen in FIG. 5, for guiding the push-button 60 and the cutting blade 58 so as to provide a scissors-type cutting action. As indicated at 66, the push-button 60 may be spring-bias to the non-cutting position.

Referring to FIGS. 6 and 7, a less expensive embodiment of the invention is illustrated at 70 as comprising a housing 72 with a supply spool 74 and a waste spool 76 each fixedly mounted on a rotatably mounted spindle 78 for mutual rotation. A pair of guides, which again could be rollers, 80 and 82 guide the waste 16 to the waste spool 76 and the adhesive-backed repair strip 12,14 toward an axis opening 84. The waste spool 76 has an internal hub or spindle portion 86 which is tapered so as to pull the waste 16 at an angle away from the repair material 12, 14 so as to collect the waste.

As with the embodiment of FIGS. 1–5, and with the same general structure as in that embodiment, a cutting mechanism is provided and comprises a fixed cutting blade 88 and a movable cutting blade 90 which is carried by a push-button 92. The push-button 92 may be biased toward its non-cutting position by means of a spring bias as indicated at 94.

In summary, therefore, the repaired damage, according to the present invention, will be almost invisible, particularly with optimum matching of the repair strip, which may be of the same nylon material as the hose, with the original hose. Particularly when the match includes a complementary color shade and/or complementary denier in respect of the damaged area.

The present invention provides the following benefits to the user;

1. Emotional security by alleviating fear of having an unsightly run or damage to nylon hosiery which could ruin a lady's appearance at an important moment;
2. Allow greater freedom of movement, action and accessory wear by providing a means to instantly repair hosiery, particularly nylon hosiery;
3. Continued wear of hosiery which has developed a run or other minor damage;
4. Economy by allowing the damaged hosiery to be worn for an acceptable appearance, instead of requiring immediate disposal of the hosiery; and
5. Emergency convenience of quick repair.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A hosiery repair kit comprising:

a tape including a repair layer having a textured appearance, and an adhesive layer on said repair layer;

a peel-off removable support layer carrying said adhesive layer, with repair and adhesive layers to be removed from said support layer so that said repair layer may be applied to a hose and adhered thereto by said adhesive layer;

said carrier means comprising a first reel having said tape wound thereon, a second reel mounted for rotation with said first reel to take up the removable support layer after the same has parted from said adhesive layer; and a single spindle mounted for rotation; said first and second reels fixedly mounted on said spindle for mutual rotation.

2. The repair kit of claim 1, wherein said carrier means comprises cutting means for cutting the tape.

3. The repair kit of claim 1, wherein:

said first and second reels are coaxially mounted for mutual rotation.

4. The repair kit of claim 1, wherein the second reel comprises a shaped spindle portion which, in longitudinal section, tapers axially and radially inward from each end of said spindle portion toward the center of said spindle portion.

5. A hosiery repair kit comprising:

a tape including a repair layer having a textured appearance and an adhesive layer on said repair layer;

a peel-off removable support layer carrying said adhesive layer, said repair and adhesive layers to be removed from said support layer so that said repair layer may be applied to a hose and adhered thereto by said adhesive layer;

said carrier means comprising a first reel having said tape wound thereon, a second reel mounted for rotation with said first reel to take up the removable support layer after the same has parted from said adhesive layer;

spindle means mounted for rotation, said spindle means comprising first and second spindles mounted on intersecting axes; and said first and second reels each including two edges each comprising teeth, said reels respectively mounted on said first and second spindles with their teeth engaged for mutual rotation.

6. The repair kit of claim 5, wherein said carrier means comprises cutting means for cutting said tape.

* * * * *